US006895097B2

(12) United States Patent
Furuyama

(10) Patent No.: US 6,895,097 B2
(45) Date of Patent: May 17, 2005

(54) PLANAR TYPE SPEAKER AND SYSTEM USING IT

(75) Inventor: Iwao Furuyama, Kanagawa (JP)

(73) Assignee: Fal Company Limited, Tokyo (JP)

( * ) Notice: Subject to any disclaimer, the term of this patent is extended or adjusted under 35 U.S.C. 154(b) by 0 days.

(21) Appl. No.: 10/637,541

(22) Filed: Aug. 11, 2003

(65) Prior Publication Data

US 2004/0101149 A1 May 27, 2004

(30) Foreign Application Priority Data

Nov. 26, 2002 (JP) ..... 2002-342274

(51) Int. Cl.[7] ..... H04R 25/00

(52) U.S. Cl. ..... 381/152; 381/398; 381/423; 381/431; 181/171

(58) Field of Search ..... 381/152, 396, 381/398, 403, 431, 423, 424, 425, 429; 181/171, 172, 157

(56) References Cited

U.S. PATENT DOCUMENTS 6,160,898 A * 12/2000 Bachmann et al. ..... 381/425
6,460,651 B1 * 10/2002 Sahyoun ..... 181/157
6,490,363 B1 * 12/2002 Liu ..... 381/403

* cited by examiner

*Primary Examiner*—Huyen D. Le
(74) *Attorney, Agent, or Firm*—Browdy and Neimark, P.L.L.C.

(57) ABSTRACT

A planar type speaker keeps its diaphragm (2) free from any distortion in operation, thus providing high fidelity sound reproduction. The diaphragm (2) is of a planar type and surrounded by a flexible edge member (3). This member (3) is constructed of an inner edge piece (3*a*) and an outer edge piece (3*b*) each of which has a semicircular shape in cross section to provide a convex surface and a concave surface. These edge pieces (3*a*, 3*b*) are the same in construction, but are inverted in arrangement to have the concave surfaces thereof face to each other to sandwich the diaphragm (2) between the concave surfaces of the edge pieces (3*a*, 3*b*); and, the outer edge piece (3*b*) is provided with a plurality of notched holes (7) which are symmetrically arranged in the outer edge piece (3*b*).

10 Claims, 8 Drawing Sheets

PLANAR TYPE SPEAKER AND SYSTEM USING IT

BACKGROUND OF THE INVENTION

1. Field of the Invention

The present invention relates to a planar type speaker provided with a diaphragm (i.e., vibrating plate), and more particularly to the planar type speaker and a speaker system using the speaker, wherein the diaphragm is of a planar type.

2. Description of the Related Art

One of general type diaphragms used in a conventional speaker assumes a conical shape as a whole. In the prior art, there is also another general type diaphragm, which assumes a planar shape used in a planar type speaker. A conventional one of the planer type speakers is disclosed, for example, in Japanese Utility Model Publication No. S57-12634 (Publication date: 1982).

In the planar type speaker of this Japanese Utility Model Publication, as shown in FIGS. 7 and 8, a diaphragm 31 is constructed of a flat plate. Fixedly mounted on a rear surface of the diaphragm 31 are a plurality of coil bobbins 33. Wound around each of these coil bobbins 33 is a piece of wire to form a voice coil 32. The diaphragm 31 is surrounded by a frame 35 and supported on each side by this frame 35 through a flexible membrane piece (hereinafter referred to simply as the "edge member" 34). The edge member 34 assumes a semicircular shape in cross section, and encircles the entire outer peripheral edge of the diaphragm 31.

The edge member 34 is provided with a notched hole 36 in each of its four corner portions to permit the diaphragm 31 to displace or move vertically relative to the frame 35, as viewed in FIG. 8.

In the conventional planar type speaker, as described above, the notched hole 36 is provided in each of the four corner portions of the edge member 34 thereby helping the diaphragm 31 vertically displace or move relative to the frame 35. However, these notched holes 36 of the edge member 34 permit an air mass confined in a speaker enclosure (hereinafter referred to as the "enclosure air") to escape from the enclosure. Such escape of the air passing through the notched holes 36 of the edge member 34 results in a distortion of the diaphragm 31, which causes a phase shift to impair the speaker's performance, particularly, in fidelity in sound reproduction thereof.

In the conventional speaker, as shown in FIG. 8, the voice coil 32 has a cylindrical shape. Such ordinary cylindrical voice coil itself merely offers a slight inductance in operation, in addition to a d-c resistance of wire of the voice coil. Further, as for the frequency characteristics, there is not any remarkable change in the voice coil. However, once the voice coil is put in a magnetic gap (i.e., an air gap in a magnetic circuit) and fixedly mounted on the diaphragm or like vibrating member, the characteristics of the voice coil drastically change in operation. In other words, when an acoustic signal is fed to the voice coil, an alternating magnetic force is produced in the voice coil so that the voice coil is magnetically moved. As the voice coil moves, a corresponding back electromotive force (back-emf) is produced in the voice coil so that an impedance of the voice coil increases in operation.

The impedance characteristic of the voice coil is very shape at the beginning of its graph to assume a crest-like form (at a lowest resonance frequency (Hz) f0), which is followed by a simple ascending slope. In the past, in order to flatten the impedance characteristic of the voice coil, an impedance correction circuit is employed.

SUMMARY OF THE INVENTION

As described above, the planar type speaker of conventional type suffers from various types of problems. Consequently, it is an object of the present invention to provide: a planer type speaker, which is free from any of the problems inherent in the conventional planer type speaker; and, a speaker system using the planer type speaker of the present invention.

In other words, it is an object of the present invention to provide a planer type speaker with a diaphragm (i.e., vibrating plate), and further to provide a speaker system using the planar type speaker of the present invention, wherein the diaphragm is substantially free from any distortion in operation to enable the speaker to provide high fidelity sound reproduction.

It is another object of the present invention to provide a planar type speaker, which is substantially free from any inductance and is also capable of flattening its impedance characteristic without employing any impedance correction circuit.

In accordance with a first aspect of the present invention, the above objects of the present invention are accomplished by providing:

In a planar type speaker comprising: a planar diaphragm (2); and, an edge member (3) surrounding the diaphragm (2), the improvement wherein: the edge member (3) is constructed of an inner edge piece (3*a*) and an outer edge piece (3*b*) each of which has a semicircular shape in cross section to provide a convex surface and a concave surface, wherein the edge pieces (3*a*, 3*b*) are the same in construction, but are inverted in arrangement to have the concave surfaces thereof face to each other to sandwich the diaphragm (2) between the concave surfaces of the edge pieces (3*a*, 3*b*); and, the outer edge piece (3*b*) is provided with a plurality of notched holes (7) which are symmetrically arranged in the outer edge piece (3*b*).

In the planar type speaker having the above construction, preferably a voice coil (11) is disposed in a rear surface of the diaphragm (2); and, a portion of the voice coil (11) is disposed outside a magnetic field created by a permanent magnet (13).

Further, preferably each of the diaphragm (2) and the edge member (3) has a rectangular shape as a whole; the notched hole (7) is provided in each of corner portions of the outer edge piece (3*b*); the voice coil (11) disposed in the rear surface of the diaphragm (2) has a rectangular shape in winding configuration.

Still further, preferably one of two pairs of opposite sides of the voice coil (11) are disposed outside a magnetic field created by a permanent magnet (13).

Preferably, the voice coil (11) is constructed of a piece of rectangularly-wound wire wound around a pair of coil winding plates (8, 9) which are parallel to each other and perpendicularly fixed to the rear surface of the diaphragm (2).

Further, preferably the wire of the voice coil (11) extends along both an inner peripheral surface and an outer peripheral surface of each of the coil winding plates (8, 9).

Still further, preferably the diaphragm (2) is constructed of a foamed element, which has both a front and a rear surface thereof coated with a woodworking-use adhesive having been cured.

Preferably, the formed element is made of expanded polystyrene.

Further, preferably the formed element has a thickness of approximately 4 mm.

In accordance with a second aspect of the present invention, the objects of the present invention are accomplished by providing:

A speaker system comprising the planer type speaker described above.

In the above speaker system, preferably the planar type speaker comprises an enclosure (6) which has its front surface inclined.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

The best modes for carrying out the present invention will be described in detail using embodiments of the present invention with reference to the accompanying drawings.

Figure 1:
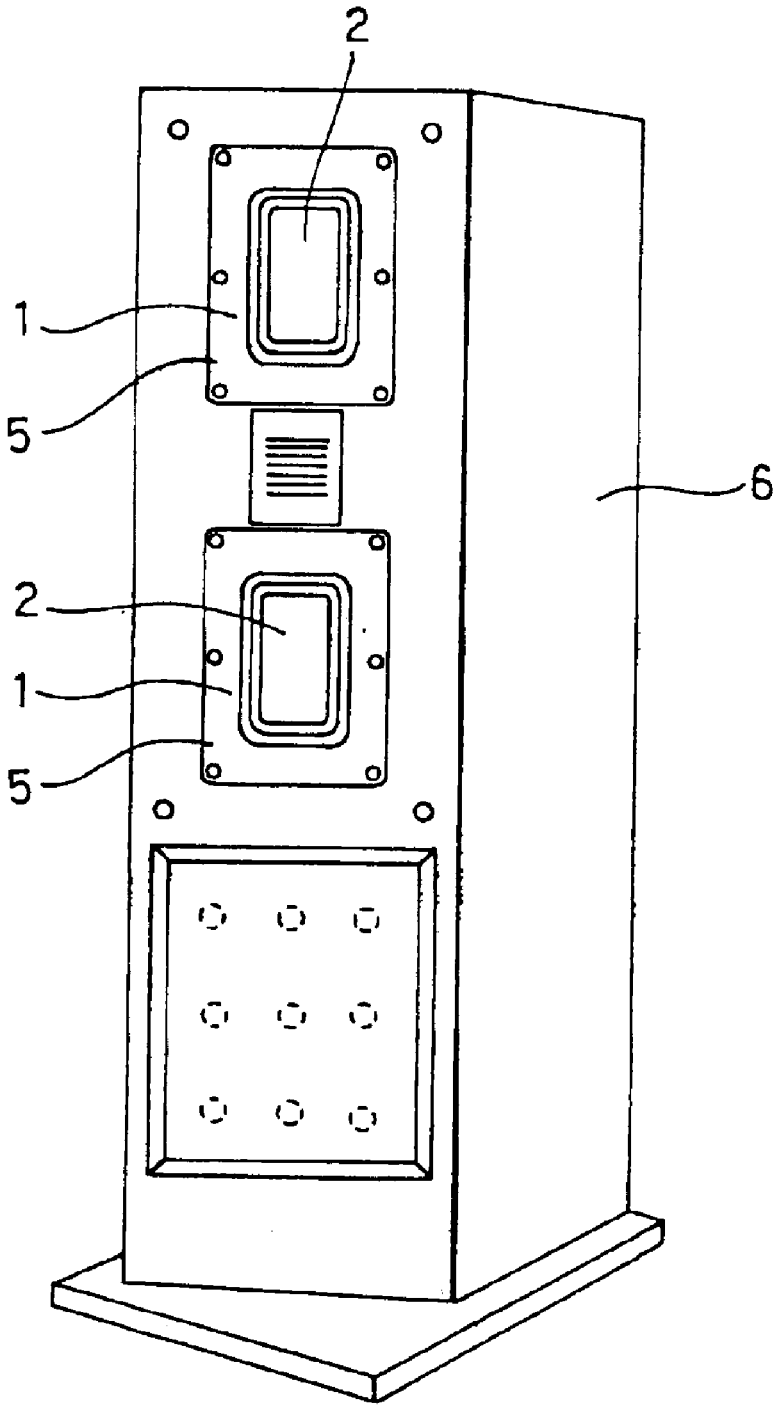
FIG. 1 is a perspective view of the planar type speaker of the present invention incorporated in the speaker system according to the present invention, illustrating the inclined front side of the enclosure.

FIG. 1 shows an embodiment of a speaker system of the present invention, in which a pair of planar type speakers 1 of the present invention are incorporated. As shown in FIG. 1, the system comprises an enclosure 6, which assumes a trapezoidal shape in cross section. In this trapezoidal shape, its right side differs from its left side in length (see FIG. 2) so that a front side or surface of the enclosure 6 is inclined, as shown in FIG. 1.

It is well known that a general type enclosure assumes a square or rectangular shape in cross section. In this general type enclosure, an air mass confined in the enclosure 6 (hereinafter referred to as the enclosure air) is expanded and compressed as the speaker 1 vibrates. Such expansion and compression of the enclosure air is known as a so-called "spring effect". When the enclosure 6 is hermetically sealed, the "spring effect" of the enclosure air causes a so-called "back pressure" leading to a stationary wave in the enclosure. The presence of such a stationary wave inside the enclosure 6 considerably adversely affects the speaker's performance, particularly, in response in low frequency range of the speaker. When the interior of the enclosure 6 is increased in volume, it is possible to decrease the "spring effect" of the enclosure air. However, this is not practical in view of to-day's demand for downsized speaker systems.

Figure 2:
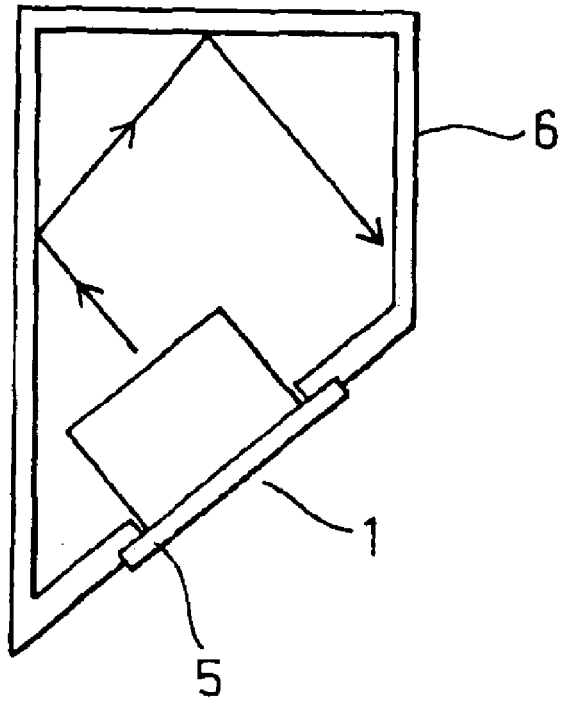
FIG. 2 is a cross-sectional view of the enclosure of the speaker system shown in FIG. 1.

As shown in FIG. 1, when the enclosure 6 has the inclined front side, i.e., has the trapezoidal shape in cross section as described above, the back pressure produced behind the speaker 1 in operation (see FIG. 2) is first reflected by the left side of the enclosure 6 and then reflected by a rear side of the enclosure 6, so that the back pressure thus reflected fails to return to the speaker 1 as indicated by the arrows in FIG. 2. Due to this, the speaker 1 of the present invention is substantially free from any influence of the stationary wave caused by the "spring effect" of the enclosure air.

Figure 4:
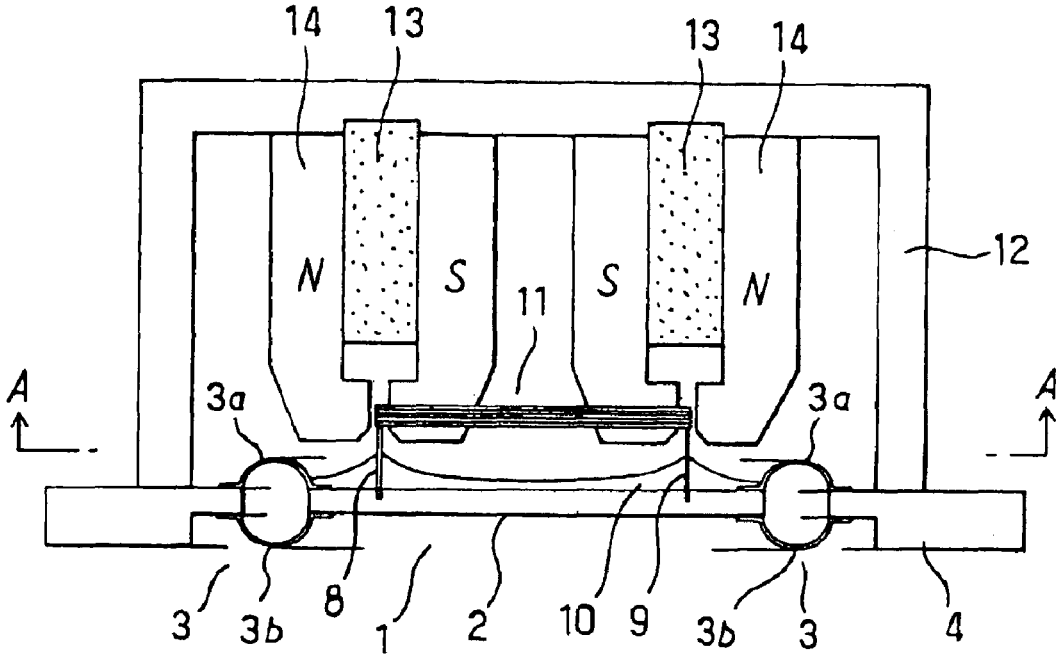
FIG. 4 is a cross-sectional view of the planar type speaker of the present invention shown in FIG. 1.

The planar type speaker 1 is provided with: a planar diaphragm 2 having a rectangular shape as a whole; a flexible edge member 3 surrounding the entire outer peripheral edge portion of the diaphragm 2; a frame 4, which is constructed of an aluminum member in general; and, a speaker mounting plate 5. As shown in FIG. 4, the diaphragm 2 is mounted on the frame 4 through the flexible edge member 3. On the other hand, the frame 4 is fixedly mounted on the speaker mounting plate 5, which is then fixedly mounted on the inclined front side or surface of the enclosure 6.

The diaphragm 2 is of a planar type. The performance of the speaker 1 is improved by the use of as light the diaphragm 2 as possible. It is also necessary for the diaphragm 2 to be sufficiently stiff in construction and to hold a large volume of air inside the diaphragm 2. Such a large volume of air held inside the diaphragm 2 increases the internal loss of the diaphragm 2.

In order to increase the volume of air held inside the diaphragm 2, preferably the diaphragm 2 is made of foamed polystyrene. In this case, the diaphragm 2 is produced stepwise, as follows: plastic beads, which is the starting material for production of foamed polystyrene products, are first heated in a vessel, so that the plastic beads are preliminary expanded or foamed and then subjected to an aging treatment to produce pre-forms. Such pre-forms are then transferred to a mold, into which a steam is injected to heat the mold, so that the pre-forms are formed into a finished foamed planar product a thickness of which is preferably about 4 mm. Then, such foamed planar product has its rear surface coated with a woodworking-use adhesive, which is of a water-based type, for example. The adhesive is then dried and cured on the rear surface of the planar product. On the other hand, applied to a front surface of the foamed planar product is a finishing member such as Japanese paper or like decorative piece. After that, the finishing member is coated with the adhesive, which is then dried and cured on the front surface of the foamed planar product, so that the foamed planar product is considerably improved in stiffness as a whole in construction.

The diaphragm 2 is constructed of the foamed planer product described above. Due to this, the diaphragm 2 is uniform in cellular size of its foam particles. In addition, the diaphragm 2 is considerably light in weight and is uniform in quality in any portion. Further, the air is uniformly held inside the diaphragm 2. Due to this, the diaphragm 2 of the present invention is higher in percentage of air content than any other types of to-day's diaphragms in use. As for the internal loss, the diaphragm 2 of the present invention is also higher than any other types of to-day's diaphragms in use. Consequently, in operation, such higher internal loss of the diaphragm 2 is capable of substantially canceling out its material's defect (i.e., resonance).

Figure 3:
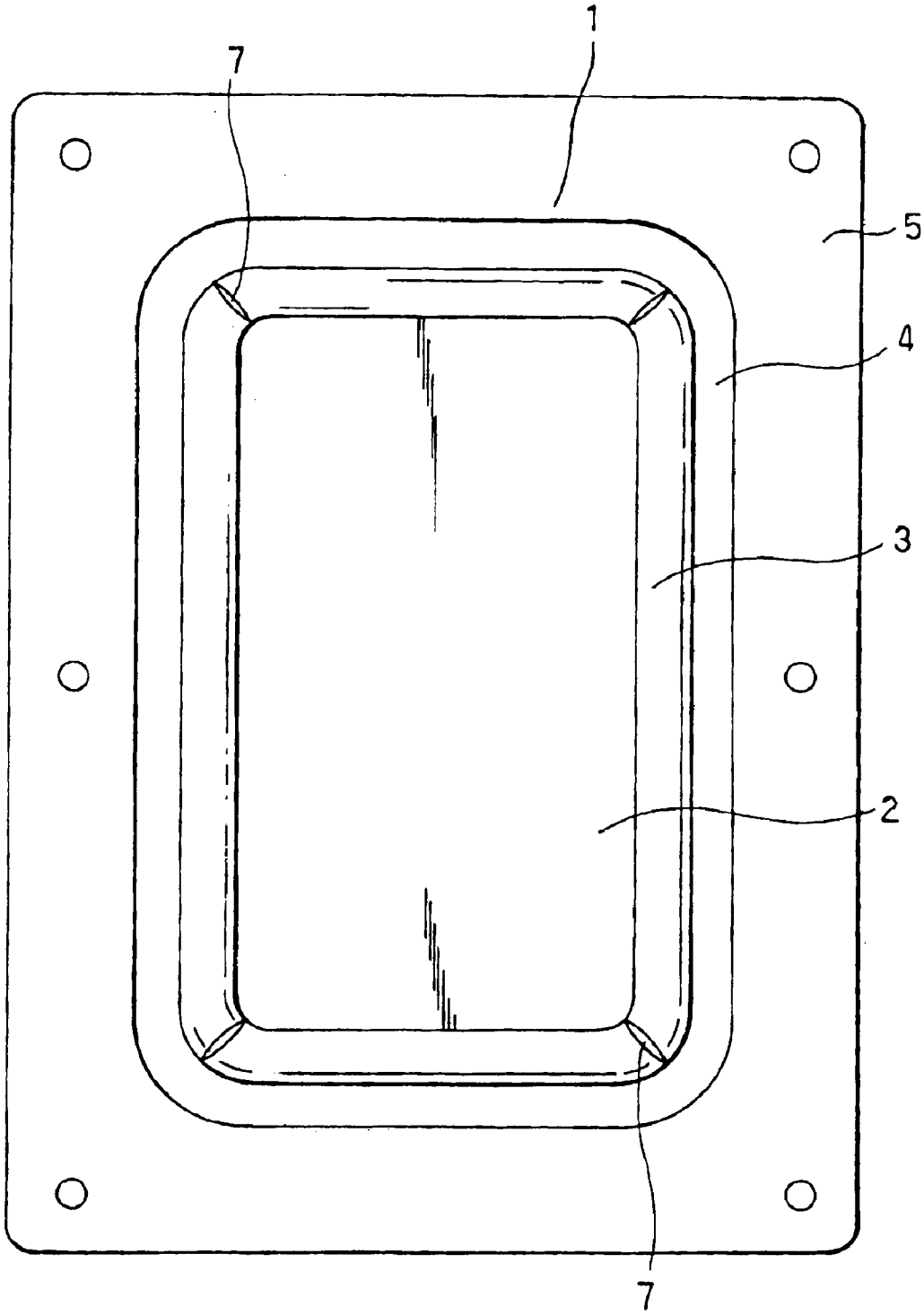
FIG. 3 is an enlarged front view of the planar type speaker of the present invention shown in FIG. 1.

As shown in FIG. 4, the flexible edge member 3 for mounting the diaphragm 2 on the frame 4 is constructed of a flexible inner edge piece 3*a* and a flexible outer edge piece 3*b* each of which is made of the same material as that of the corresponding edge member of a conventional planar type speaker (which is, for example, made of polyurethane resins having been heat-pressed). Each of the inner edge piece 3*a* and the outer edge piece 3*b* of the flexible edge member 3 has a semicircular shape in cross section to provide a convex surface and a concave surface, and further has a substantially rectangular shape in plan view (see FIG. 3). These flexible edge pieces 3*a*, 3*b* of the edge member 3 are the same in construction, but are inverted in arrangement to have the concave surfaces thereof face to each other to sandwich the diaphragm 2 therebetween. As is clear from FIG. 3, the outer edge piece 3*b* of the edge member 3 is provided with a plurality of notched holes 7 which are symmetrically arranged in the outer edge piece 3*b*. The total number of the notched holes 7 of the outer edge piece 3*b* is four in this embodiment (see FIG. 3). Each of the inner edge piece 3*a* and the outer edge piece 3*b* has its opposite side edges flattened to form a pair of flange portions 3*c*. These flange portions 3*c* are fixedly mounted on the fame 4 so as to sandwich therebetween both the outer peripheral portion of the diaphragm 2 and the inner peripheral portion of the frame 4 (see FIG. 4).

Figure 5:
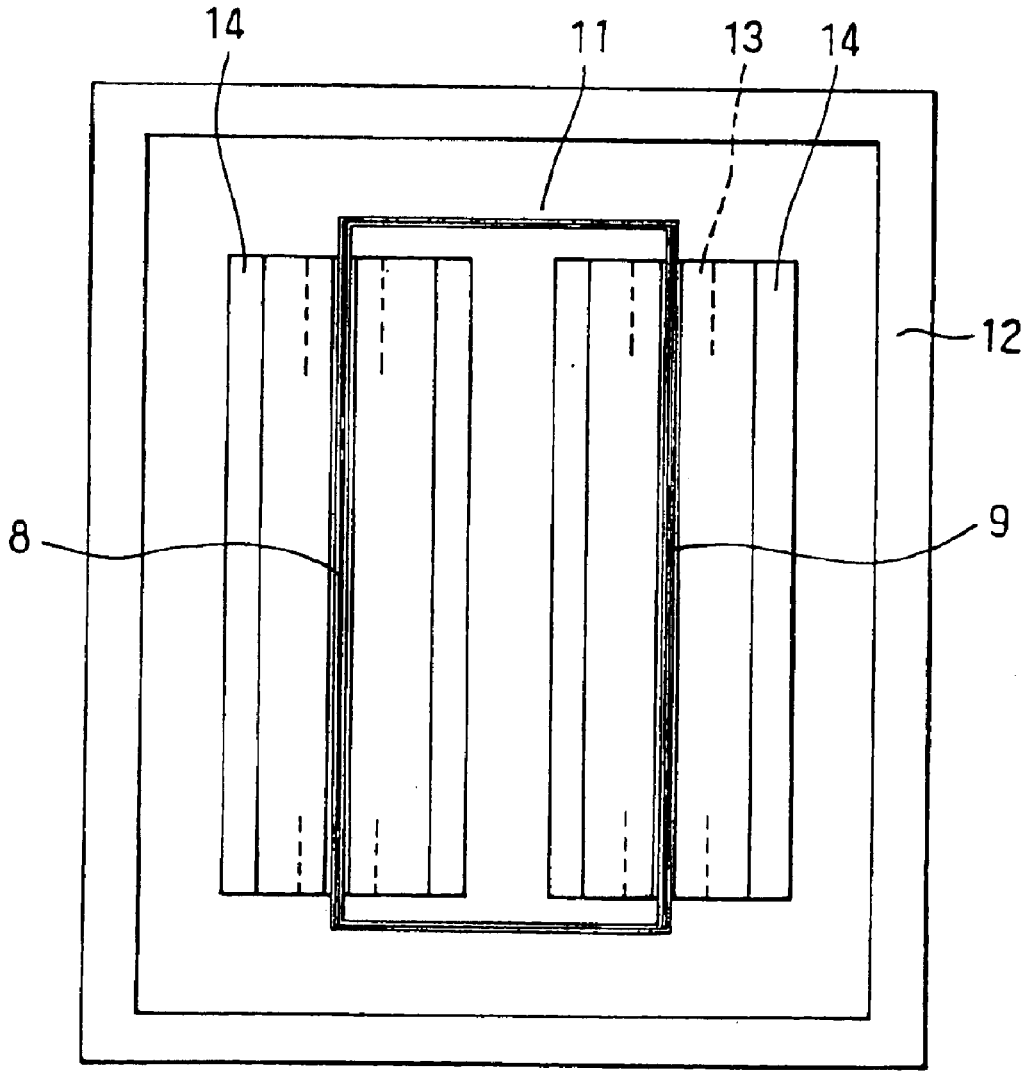
FIG. 5 is a longitudinal sectional view of the planar type speaker of the present invention, taken along the line A—A of FIG. 4.

On the other hand, as shown in FIGS. 4 and 5, a voice coil 11 is constructed of a piece of rectangularly-wound wire wound around a pair of coil winding plates 8, 9, which are parallel to each other and perpendicularly fixed to the rear surface of the diaphragm 2. The thus wound wire of the voice coil 11 extends along both an inner peripheral surface and an outer peripheral surface of each of the coil winding plates 8, 9, each of which is constructed of a thin plastic plate made of heat-resisting plastic material. One of opposite end portions of each of the coil winding plates 8, 9 is embedded in the rear surface of the diaphragm 2 (see FIG. 4). After that, each of the coil winding plates 8, 9 has a root portion of its embedded end portion reinforced by a plastic layer 10 of the same heat-resisting plastic material described above or of another kind of heat-resisting plastic material which is different from that of the above-mentioned thin plastic plate, so that both the coil winding plates 8, 9 are firmly fixed to the rear surface of the diaphragm 2.

Figure 6:
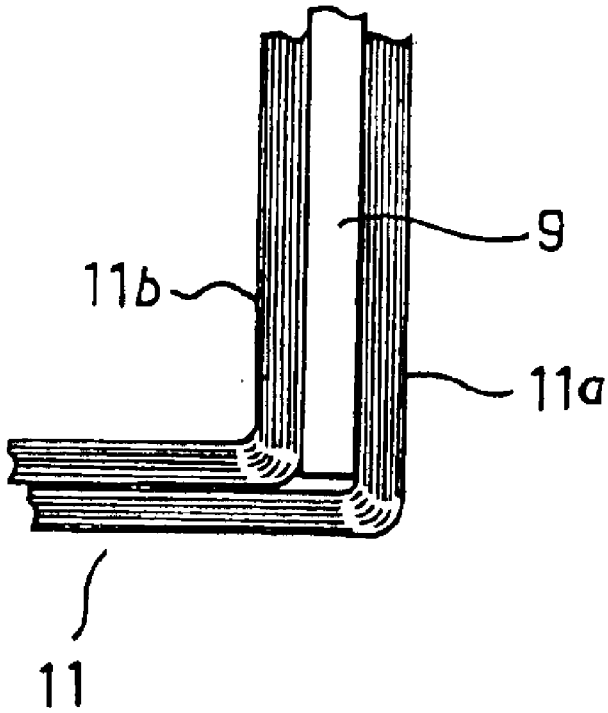
FIG. 6 is a partially enlarged front view of a corner portion of the voice coil of the planar type speaker shown in FIG. 5.
Figure 7:
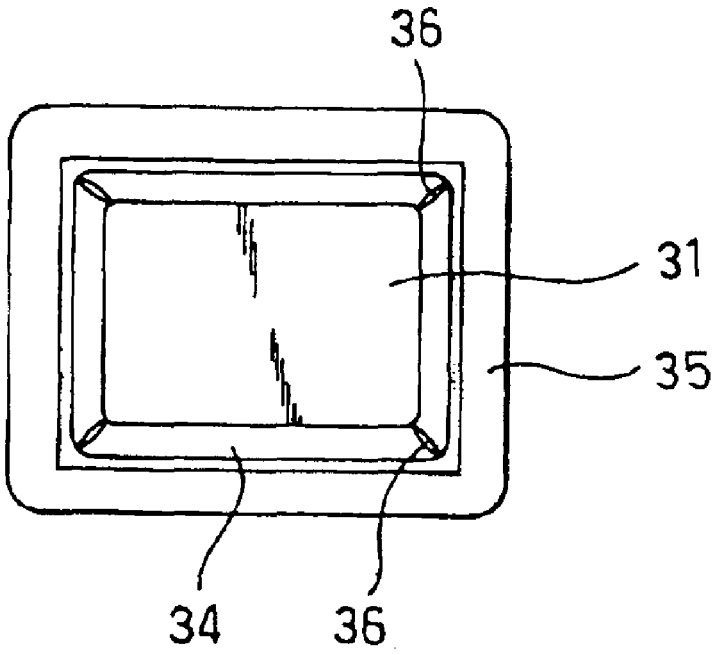
FIG. 7 (PRIOR ART)
FIG. 7 is a front view of a conventional planar type speaker.
Figure 8:
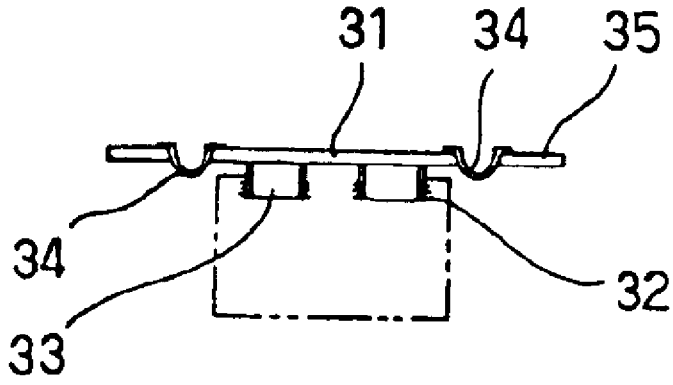
FIG. 8 (PRIOR ART)
FIG. 8 is a cross sectional view of the conventional planar type speaker shown in FIG. 7.

Wound around the coil winding plates 8, 9 in the same direction is the wire of the voice coil 11 for forming an alternating magnetic field when an acoustic current is supplied to the coil 11. As described above with reference to FIGS. 4 and 5, the thus wound wire of the voice coil 11 extends in the same direction along both the inner peripheral surface and the outer peripheral surface of each of the coil winding plates 8, 9 to form: an outer coil portion 11*a* disposed adjacent to the outer peripheral surface of each of the coil winding plates 8, 9; and, an inner coil portion 11*b* disposed adjacent to the inner peripheral surface of each of the coil winding plates 8, 9. As is clear from FIGS. 5 and 6, the voice coil 11 assumes a substantially rectangular shape in winding configuration or in plan view as a whole. It is natural that the outer coil portion 11*a* and the inner coil portion 11*b* are constructed of the same single continuous wire wound around the coil winding plates 8, 9 in the same direction.

The voice coil 11 is disposed in the rear surface of the diaphragm 2. A portion (i.e., one of two pairs of opposite sides) of the rectangularly-shaped voice coil 11 is disposed outside a magnetic field created by a permanent magnet 13, which is sandwiched between a pair of elongated leg portions (denoted by the letter "S", "N" which indicate magnetic poles) of a yoke member 14, as shown in FIG. 4.

On the other hand, an inverted U-shaped angle member 12 shown in FIG. 4 has its opposite free ends fixedly mounted on the rear surface of the frame 4. Fixedly mounted on an inner peripheral surface of the angle member 12 a pair of symmetrically-arranged yoke members 14, each of which extends in parallel with each of the corresponding coil winding plates 8, 9 in a direction perpendicular to the rear surface of the diaphragm 2, so that the permanent magnet 13 is arranged to extend at right angles relative to the rear surface of the diaphragm 2. A pair of lower ends of the elongated leg portions of the yoke member 14 are spaced apart from each other to form an air gap (i.e., magnetic gap) therebetween. The voice coil 11, which is rectangular in shape and therefore has four sides each extending at right angles relative to adjacent one, has one of two pairs of its opposite sides loosely put or inserted in the magnetic gap to permit the coil 11 to displace or move therein (see FIG. 5). On the other hand, the other one of such two pairs of opposite sides of the voice coil 11 are disposed outside the magnetic field created by the permanent magnet 13, as is clear from FIG. 5.

In construction, as described above, since the diaphragm 2 is supported by the frame 4 through a pair of the flexible inner edge piece 3*a* and the flexible outer edge piece 3*b* of the edge member 3, it is possible for the diaphragm 2 to be free from any harmful vibrations in operation. Further, since the notched holes 7 are formed in four corners of the outer edge piece 3*b* of the edge member 3, any excessive damping effect on the diaphragm 2 is eliminated, which improves the diaphragm 2 in vibration characteristics to make it possible for the speaker 1 to provide high fidelity sound reproduction in performance. Owing to the above properties of the diaphragm 2, it is possible to improve the voice coil 11 inefficiency, and also possible to downsize the voice coil 11, i.e., to shorten the voice coil 11 in length, which realizes a so-called "short voice coil".

As is clear from the drawings, the yoke member 14 does not form a closed magnetic circuit due to its inverted U-shaped form shown in FIG. 4. Due to this, as is clear from FIG. 5, the magnetic circuits created by the permanent magnets 13 pass through only the above-mentioned one of two pairs of opposite sides of the voice coil 11, which one pair are put in the magnetic gaps. Further, as is clear from the above, any magnetic field does not appear in both an upper and a lower portion of the yoke member 14. Due to this, any inductance does not appear in the upper and the lower portion of the yoke member 14. As a result, it is possible for the speaker 1 of the present invention to enjoy its flattened impedance characteristic without employing any impedance correction circuit.

In the preferred embodiment of the speaker 1 of the present invention described above, though each of the diaphragm 2 and the flexible edge member 3 assumes the rectangular shape as a whole, it is also possible to replace the rectangular shape with any other suitable shape such as a circular shape, an oval shape, a hexagonal shape or the like. When any other suitable shape described above is used in place of the rectangular shape, it is preferable to wind the wire of the voice coil 11 into the same shape as that of the diaphragm 2. In other words, when the diaphragm 2 assumes a circular shape, the wire of the voice coil 11 is wound around a pair of coil winding plates 8, 9 each of which assumes a circularly-curved shape, which enables the wire to be circularly wound around the coil winding plates 8, 9.

In the planar type speaker 1 of the present invention having the above construction, since the diaphragm 2 is supported by both the flexible inner edge piece 3*a* and the flexible outer edge piece 3*b* which is provided with the notched holes 7, the diaphragm 2 is substantially free from any distortion in operation. Due to this, it is possible for the speaker 1 to precisely convert the driving current into acoustic energy, thus suppressing a phase shift of the energy in operation, so that the speaker 1 is capable of providing high fidelity sound reproduction.

In addition, in the speaker 1 of the present invention, since the voice coil 11 is partially disposed outside the magnetic field created by the permanent magnet 13 in construction, the voice coil 11 suffers from substantially no inductance in operation. Due to this, it is possible for the speaker 1 of the present invention to enjoy its flattened impedance characteristic without employing any impedance correction circuit.

Further, in the speaker 1 of the present invention, since the diaphragm 2 is constructed of the foamed element made of foamed polystyrene or like foamed material, the diaphragm 2 is considerably light in weight and homogeneous in construction. Further, the diaphragm 2 holds a large amount of air in the interior thereof. Such a large amount of air held inside the diaphragm 2 functions to prevent the diaphragm 2 from resonating in vibration, thus improving both the speaker 1 and the speaker system of the present invention in frequency characteristics.

Finally, the present application claims the Convention Priority based on Japanese Patent Application No. 2002-342274 filed on Nov. 26, 2002, which is herein incorporated by reference.

What is claimed is:

1. In a planar speaker comprising: a planar diaphragm (2); and, an edge member (3) surrounding said diaphragm (2), the improvement wherein:

said edge member (3) is constructed of an inner edge piece (3*a*) and an outer edge piece (3*b*) each of which has a semicircular shape in cross section to provide a convex surface and a concave surface, wherein said edge pieces (3*a*, 3*b*) are the same in construction, but are inverted in arrangement to have said concave surfaces thereof face to each other to sandwich said diaphragm (2) between said concave surfaces of said edge pieces (3*a*, 3*b*); said outer edge piece (3*b*) is provided with a plurality of notched holes (7) which are symmetrically arranged in said outer edge piece (3*b*), each of said diaphragm (2) and said edge member (3) has a rectangular shape as a whole; said notched hole (7) is provided in each of corner portions of said outer edge piece (3*b*); and a voice coil (11) disposed in a rear surface of said diaphragm (2) has a rectangular shape in winding configuration.

2. The planar speaker as set forth in claim 1, wherein: said voice coil (11) is disposed behind a rear surface of said diaphragm (2); and, a portion of said voice coil (11) is disposed outside a magnetic field created by a permanent magnet (13).

3. The planar speaker as set forth in claim 1, wherein: one of two pairs of opposite sides of said voice coil (11) are disposed outside a magnetic field created by a permanent magnet (13).

4. The planar speaker as set forth in claim 1, wherein said voice coil (11) is constructed of a piece of rectangularly-wound wire wound around a pair of coil winding plates (8, 9) which are parallel to each other and perpendicularly fixed to said rear surface of said diaphragm (2).

5. The planar speaker as set forth in claim 4, wherein said wire of said voice coil (11) extends along both an inner peripheral surface and an outer peripheral surface of each of said coil winding plates (8, 9).

6. The planar speaker as set forth in claim 1, wherein said diaphragm (2) is constructed of a foamed element, which has both a front and a rear surface thereof coated with a woodworking-use adhesive having been cured.

7. The planar speaker as set forth in claim 6, wherein said foamed element is made of expanded polystyrene.

8. The planar speaker as set forth in claim 6, wherein said formed element has a thickness of approximately 4 mm.

9. A speaker system comprising said planar speaker as set forth in any one of claims 1–2 and 3–8.

10. The speaker system as set forth in claim 9, wherein said planar speaker comprises an enclosure (6) having its front surface inclined.

* * * * *